United States Patent [19]

de Oliveira et al.

[11] Patent Number: 4,768,984

[45] Date of Patent: Sep. 6, 1988

[54] BUOY HAVING MINIMAL MOTION CHARACTERISTICS

[75] Inventors: Joao G. de Oliveira; Arthur W. Morton; Paul R. Erb, all of Houston, Tex.; Michael S. Triantafyllou, Cambridge, Mass.

[73] Assignee: Conoco Inc., Ponca City, Okla.

[21] Appl. No.: 723,407

[22] Filed: Apr. 15, 1985

[51] Int. Cl.[4] ..... B63B 22/18

[52] U.S. Cl. ..... 441/21; 441/1; 441/3; 405/195; 166/350

[58] Field of Search ..... 441/3, 4, 5, 21, 23, 441/28, 29; 114/230, 264; 405/202, 195; 166/350, 359, 367

[56] References Cited

U.S. PATENT DOCUMENTS

| | | | |
|---|---|---|---|
| 3,568,228 | 1/1969 | Rudelick | 441/3 |
| 4,188,156 | 2/1980 | Fisher et al. | 405/195 |
| 4,256,417 | 3/1981 | Bohannon | 405/195 |
| 4,280,238 | 7/1981 | van Heijst | 441/21 |
| 4,284,143 | 8/1981 | Scherrer et al. | 166/350 |

FOREIGN PATENT DOCUMENTS

| | | | |
|---|---|---|---|
| 1533973 | 11/1978 | United Kingdom | 441/3 |
| 2139677 | 11/1984 | United Kingdom | 405/202 |

*Primary Examiner*—Galen Barefoot
*Assistant Examiner*—Paul E. Salmon
*Attorney, Agent, or Firm*—Richard K. Thomson

[57] ABSTRACT

The present invention provides a service buoy for performing direct wireline maintenance of a subsea well. The buoy is maintained in position over the well by a rigid riser kept under tension and which allows for the well re-entry. The primary buoyant body of the buoy is maintained permanently submerged and a truss structure presenting the minimum surface area to the action of wind and waves extends above the sea level to support a small deck from which the wireline work can be performed. The centers of gravity and buoyancy for the buoy are in close proximity so as to minimize lateral surge and sway motions of the installed buoy.

13 Claims, 2 Drawing Sheets

BUOY HAVING MINIMAL MOTION CHARACTERISTICS

This invention relates to the art of offshore buoy design and, more particularly, to a buoy design which minimizes common motion characteristics of the floating structure and in an embodiment specifically adapted for oil production, allows wireline service entry to a subsea well head.

BACKGROUND OF THE INVENTION

As offshore oil and gas production move to deeper waters where production costs are higher, it becomes necessary to develop smaller or secondary fields which do not justify the costs of design and installation of fixed production platforms. The number of "marginal" subsea oil fields grows rapidly with increasing water depth and makes the concept of developing a field with satellite subsea wells attractive.

Floating production systems employing ship-shaped vessels, barges or semi-submersible-type hulls have been used to obtain early production prior to construction of permanent, bottom-founded structures. Floating production systems have also been installed to produce "marginal" subsea reservoirs with one or two wells, reservoirs which would be too small to justify the costs of development with a bottom-founded structure.

One requirement for efficient exploitation of marginal fields is the possibility of wireline re-entry into a subsea well. Wireline servicing of a well is normally conducted from fixed platforms or heave compensated floating systems. In normal conditions, a relatively large deck space is required to place the wireline unit in appropriate proximity to the lubricator as is the case for on land use of wireline equipment.

If a field is to be developed with satellite subsea wells, a major difficulty is providing an economic way to re-enter the well. In the past, if downhole work was required to change out a gas lift valve, shift a sliding sleeve or the like, the only available options would be to incorporate "pumpdown" or "through-the-flow line" tool systems into the design of the subsea well or to mobilize a drilling rig to make a direct wireline re-entry into the satellite well from the water surface immediately above the well. Through-the-flowline systems are expensive and not very reliable, thus, they have not found great favor with oil field operators. Mobilizing a drilling rig for a wireline operation of short duration is obviously very expensive.

Adaptation of known designs for floating structures, such as semi-submersible hulls and spar buoys, to function as a single well service buoy do not provide adequate sea keeping characteristics for such application. Known semisubmersible designs provide wave pressure cancellation utilizing two vertically connected cylinders, the upper cylinder being of a smaller diameter so that the total force is minimal in the heave (vertical) direction at a specific wave frequency.

While the minimalization of heave response is helpful in maintaining a stable tension on a tensioned riser, such a design has little effect on the sway (to and fro) response of the buoy which is critical to minimizing angular deviation of a tensioned vertical riser. Common spar buoys similarly minimize heave response while surge and sway response is not adequately limited. Sway motions permitted by common catenary mooring of floating structures permit only general, imprecise location of buoys as navigational aids, unmanned weather stations and the like.

SUMMARY OF THE INVENTION

The present invention provides an economic buoy having minimal motion characteristics for more precise location of the buoy under most sea conditions and, in an oil field application may be use for wireline re-entry into a subsea well.

In accordance with the invention, a buoy having minimal motion characteristics comprises a submerged buoyant body, the buoyant body being located beneath a first level of wind, wave and tidal action at a water surface by a tensioned, substantially rigid, substantially vertical riser extending from a subsea anchor to the buoyant body. The buoy also includes an upper truss structure extending from the submerged buoyant body to a second level above the water surface. Centers of gravity and buoyancy for the buoy are preferably substantially coincident.

Further in accordance with the invention, a buoy for interconnection with a single subsea well having a well head comprises a submerged buoyant body, the buoyant body being located beneath a first level of wave and tidal action at a water surface by a tensioned, substantially rigid, substantially vertical tubular riser extending from the well to the buoyant body. The buoy also includes an upper truss structure extending from the submerged buoyant body to a second level above the water surface. The upper truss structure further includes a platform deck attached to such structure at its upper level. The buoy has centers of gravity and buoyancy which are substantially coincident. Thus, wave-induced motion of the buoy is minimized and direct wireline re-entry maintenance of the subsea well may be easily effected from the platform deck.

Further in accordance with the invention, the above-described buoy further includes a lower truss structure between the tubular riser and the buoyant body such that the center of gravity for the buoy is located slightly above the center of buoyancy.

It is therefore an object of this invention to provide a safe, simple, effective and economical means for insuring wireline re-entry to subsea satellite wells or marginal field wells.

It is a further object of this invention to provide a small, stable platform for any type of offshore work.

BRIEF DESCRIPTION OF THE DRAWINGS

These and other objects of the invention will become apparent to those skilled in the art upon a reading and understanding of this specification taken in conjunction with the accompanying drawings forming a part thereof and in which.

DETAILED DESCRIPTION OF THE PREFERRED EMBODIMENTS AND THE DRAWINGS

Figure 1:
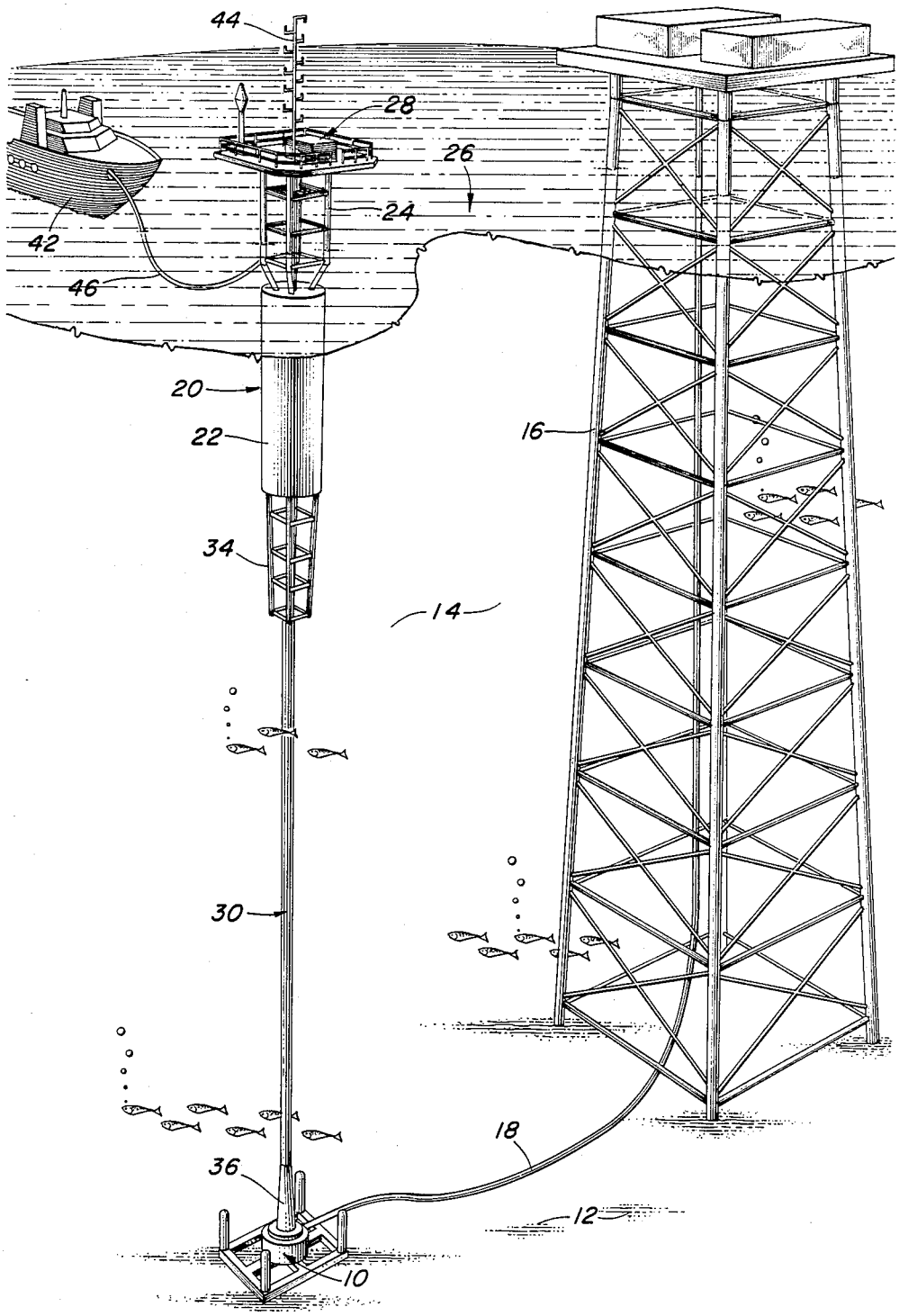
FIG. 1 is a schematic perspective view of a satellite well installation utilizing a buoy in accordance with the present invention.
Figure 2:
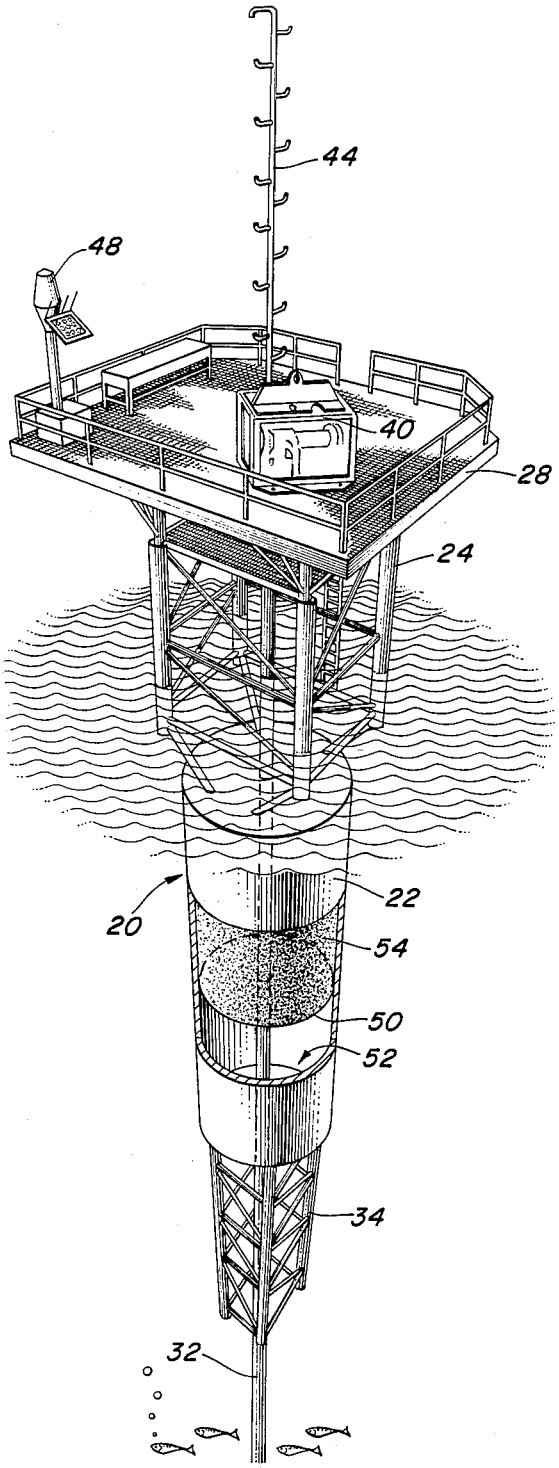
FIG. 2 is an enlarged view in partial section of the buoy in accordance with the present invention.

Referring now to the drawings wherein the showings are for the purpose of illustrating a preferred embodiment of the invention only and not for the purpose of limiting same, FIG. 1 shows a subsea satellite well 10 located on the bottom 12 of a body of water 14. The satellite well 10 is connected to a production platform 16 by a flowline 18 which is preferably an insulated flowline bundle comprising a plurality of fluid conducting pipes.

In accordance with the invention and in order to avoid the use of through-the-flowline tools from the platform 16 through the flowline 18 and into the well 10 for maintenance, a fixed service buoy 20 is provided. The service buoy 20 generally comprises a buoyant body which may be of any shape but is preferably in the form of a vertically oriented cylinder 22. An upper truss structure 24 is attached to the top of the buoyant body 22 and extends through and above the water surface 26. A platform deck 28 is provided at the top of the upper truss structure 24 as a work station.

Figure 3:
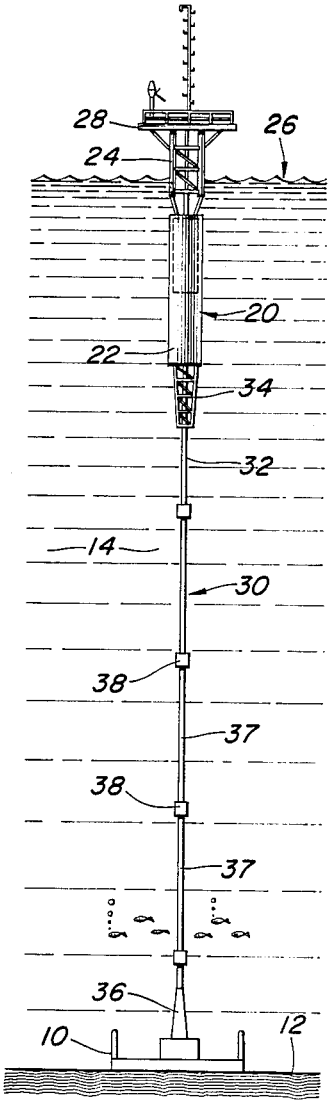
FIG. 3 is a side elevational view of a complete buoy installation in accordance with the present invention.

The service buoy 20 is interconnected with the subsea well 10 through a rigid riser 30. In accordance with a preferred emboidment of the invention, the rigid riser 30 attaches at its upper end flex joint 32 (FIG. 3) with a lower truss structure 34 attached to the bottom of the buoyant body 22. The lower end of the riser 30 is attached to the subsea well 10 utilizing a lower flex 36, the flex joints 32, 36 having a tapered structure such as that known in U.S. Pat. No. 4,256,417. Alternatively, a titanium or steel flex joint of known construction may be provided. Still further, the flex joint 32, 36 may be constructed of an axially stiffened re-enforced flexible tubing. The remainder of the rigid riser 30 is made up to the required length utilizing common steel tubular members 37 and connectors 38.

In accordance with the invention, the length of the buoy 20 and the rigid riser 30 is chosen such that the buoyant body 22 is located below surface wind, wave and tidal action under substantially all environmental conditions. This keeps the riser 30 in substantially constant tension and also provides a minimized structural area of the upper truss structure 24 to be subjected to wind and wave forces at the water surface 26.

As stated previously, a lower truss structure 34 is preferably provided on the buoy 20 in order to vertically lower the centers of gravity and buoyancy of the buoy 20. In the preferred embodiment, the center of buoyancy substantially coincides with or is slightly below the axial center of gravity for the buoy 20. Maximum stability for the installed buoy is afforded by the close proximity of the centers of gravity and buoyancy. The close proximity of the centers of gravity and buoyancy is necessary in maintaining acceptable sea keeping performance for the buoy. If this proximity is not obtained by the design of the buoy, the buoy will exhibit amplification rather than attenuation of its response to sea force, a condition which is totally unsuitable. Failure to minimize the effects of surge and sway motions induced by sea forces could result in unacceptable angular offset of the rigid veritcal riser 30 to the point of catastropic failure.

The present invention provides a small but stable platform from which wireline re-entry to a subsea well can be conducted. The upper truss structure 24 supports at the top a small deck 28 where a wireline unit 40 is installed and which can serve for stacking the lubricator and the wireline tools. During wireline work, an operator and a helper come aboard the buoy. Lubricator equipment and the necessary wireline tools are transfered from a supply vessel 42 to the buoy using a simple lifting boom arrangement such as a mast 44. The power unit necessary to run the wireline unit is installed aboard the supply vessel 42 and power transmission is insured by floating hydraulic rubber hoses 46 extending between the supply vessel 42 and the buoy 20. Navigational requirements such as a light 48, etc. may also be provided as well as batteries and/or solar power equipment.

An important design consideration of the service buoy 20 is the installation procedure. To allow for the riser connection such that the buoyant body 22 is fully under water, provision for ballasting of the buoyant body 22 during installation is desired. For this purpose, the buoyant body is preferably internally subdivided into two compartments by a water-tight flat plate 50. The lower compartment 52 is a ballast tank which is filled with water during installation only and which is deballasted when the service buoy 20 is fully operational. The size of the ballast compartment 52 is determined by the individual installation such that it provides the exact amount of ballast required for installation. The upper compartment 54 of the buoyant body 22 is preferably filled with a polymer foam such as polyurethane to provide some reserve buoyancy should accidental damage occur to the buoyant body 22.

In installing the service buoy 20 in accordance with the invention, the rigid riser 30 is run from a floating surface vessel such as a drillship or semisubmersible drilling platform and connected to the christmas tree of the subsea well 10. To maintain the riser 30 in a vertical position, the temporary detachable buoy may be provided at its upper end to give upward lift to the riser 30. The service buoy 20 is then floated into position and ballasted down so that connector portions associated with the lower truss structure 34 can be mated with a corresponding receiving connector on the riser 30. After connection between the buoy 20 and the riser 30 which may be effected by any common connecting means, the temporary detachable buoy installed on the riser 30 is released and the buoyant body 22 is deballasted to operating condition. Under substantially all conditions of wind and wave, a buoyant (not shown) body 22 is completely submerged and wind and wave action is applied only to the upper truss structure 24.

From the foregoing it can be seen that a stable buoy having excellent sea keeping function has been disclosed. It will be apparent to those skilled in the art that the advantages afforded by this design may find considerable usefulness in general in the art of buoys. Thus, a navigational buoy having a much more precise location over typical catenary moored buoys may be made utilizing the concepts of this invention. Similarly, other buoys such as remote weather station buoys may employ these concepts.

While the invention has been described in the more limited aspects of a preferred embodiment thereof, other embodiments have been suggested and still others will occur to those skilled in the art upon the reading and understanding of the foregoing specification. It is intended that all such embodiments be included within the scope of this invention as limited only by the appended claims.

Having thus described our invention, we claim:

1. A buoy having minimal motion characteristics comprising a submerged buoyant body, said buoyant body being located beneath a first level of wind, wave and tidal action at a water surface by a tensioned, substantially rigid, substantially vertical riser extending from a subsea anchor means to said buoyant body and an upper truss structure extending from said buoyant body to a second level above said water surface, said submerged buoyant body further including a lower truss structure extending between said riser and said buoyant body, said buoy having a center of gravity and a center of buoyancy and said centers of gravity and buoyancy are substantially coincident.

2. The buoy as set forth in claim 1 further including navigational equipment mounted on said upper truss structure at said second level.

3. The buoy as set forth in claim 1 further including weather station equipment mounted on said upper truss structure at said second level.

4. The buoy as set forth in claim 1 wherein said center of gravity is located slightly vertically above said center of buoyancy.

5. A buoy for interconnecting with a single subsea well comprising a submerged buoyant body, said buoyant body being located beneath a first level of wind, wave and tidal action at a water surface by a tensioned, substantially rigid, substantially vertical tubular riser extending from said well to said buoyant body, an upper truss structure extending from said buoyant body to a second level above said water surface and a platform deck attached to said upper truss structure at said second level, said submerged buoyant body further including a lower truss structure extending between said riser and said buoyant body, said buoy having a center of gravity and a center of buoyancy and said centers of gravity and buoyancy are substantially coincident whereby direct wireline re-entry service of said subsea well may be effected from said deck.

6. A buoy as set forth in claim 5 wherein said riser includes a pair of terminal flex joints.

7. The buoy as set forth in claim 6 where each of said flex joints is a tapered joint.

8. The buoy as set forth in claim 6 wherein each of said flex joints is an axially stiffened, reinforced flexible tubing member.

9. The buoy as set forth in claim 5 wherein said center of gravity is located slightly vertically above said center of buoyancy.

10. The buoy as set forth in claim 5 wherein said buoyant body is a vertically oriented cylinder.

11. The buoy as set forth in claim 10 wherein said cylinder is internally divided into a sealed upper chamber and a lower ballast chamber.

12. The buoy as set forth in claim 11 wherein said sealed upper chamber is filled with a polymeric foam.

13. The buoy as set forth in claim 5 wherein said deck structure includes wireline service equipment.

* * * * *